US006871036B2

(12) United States Patent
Asuwa et al.

(10) Patent No.: US 6,871,036 B2
(45) Date of Patent: Mar. 22, 2005

(54) BELT DRIVING APPARATUS AND IMAGE FORMING APPARATUS USING THE SAME

(75) Inventors: Kenji Asuwa, Toride (JP); Toru Miyasaka, Tsuchiura (JP); Tomio Sugaya, Hitachinaka (JP); Hiroyuki Mabuchi, Hitachinaka (JP); Hui Cheng, Chiyoda (JP)

(73) Assignees: Hitachi, Ltd., Tokyo (JP); Ricoh Printing Systems, Ltd., Tokyo (JP)

( * ) Notice: Subject to any disclaimer, the term of this patent is extended or adjusted under 35 U.S.C. 154(b) by 0 days.

(21) Appl. No.: 10/624,558

(22) Filed: Jul. 23, 2003

(65) Prior Publication Data

US 2004/0126151 A1 Jul. 1, 2004

(30) Foreign Application Priority Data

Dec. 26, 2002 (JP) ..... 2002-375806

(51) Int. Cl.[7] ..... G03G 15/00

(52) U.S. Cl. ..... 399/302; 198/804; 198/810.01; 399/165; 399/303

(58) Field of Search ..... 399/165, 162, 399/302, 303, 308, 313; 198/804, 807, 810.01, 810.03, 810.04

(56) References Cited

U.S. PATENT DOCUMENTS 5,410,389 A * 4/1995 Poehlein ..... 399/165
6,496,672 B2 * 12/2002 Asuwa et al. ..... 399/165
2002/0034400 A1 * 3/2002 Asuwa et al. ..... 399/165

FOREIGN PATENT DOCUMENTS

EP 0 694 492 A2 * 1/1996
JP A-4-144850 5/1992

* cited by examiner

*Primary Examiner*—Sophia S. Chen
(74) *Attorney, Agent, or Firm*—Antonelli, Terry, Stout & Kraus, LLP

(57) ABSTRACT

A belt driving apparatus which inhibits a belt meandering so as to improve a printing quality and rapidly starts a printing motion at a time of starting the apparatus such as a time of turning on power or the like, and an image forming apparatus using the same. The belt driving apparatus has an endless belt, a plurality of belt tension supports for supporting the belt in a tension manner, and a steering roller supported in a tiltable manner and compensating a meandering of the belt, and the belt driving apparatus is provided with a meandering compensation sensitivity adjuster for adjusting a belt meandering compensation sensitivity of the steering roller per an angle of incline.

15 Claims, 7 Drawing Sheets

(a) ROUGH REGULATING TIME (b) FINE REGULATING TIME (a) ROUGH REGULATING TIME (b) FINE REGULATING TIME

BELT DRIVING APPARATUS AND IMAGE FORMING APPARATUS USING THE SAME

BACKGROUND OF THE INVENTION

The present invention relates to a belt driving apparatus and an image forming apparatus using the same.

DESCRIPTION OF THE PRIOR ART

As one example of an image forming apparatus using a belt driving apparatus, there has been conventionally known a tandem type color image forming apparatus provided with a plurality of independent printing units for forming toner images of respective colors comprising black, cyan, magenta and yellow, and forming a color image by one process. The image forming apparatus conveys a paper in a state of adsorbing the paper to an endless belt, and sequentially transfers a toner image on the paper so as to form a color image on the paper. The endless belt mentioned above is supported in a tension manner by a tension supporting means such as a driving roller transmitting a driving force generated by a driving means such as a motor or the like, a tension roller applying a tensile force to the belt by using an energizing means such as a spring or the like for stably conveying the belt, an idle roller defining a carrying path of the belt and the like.

In the image forming apparatus, in the case that a mounting position of the tension supporting means has a margin of error, or a support member of the tension supporting means has a deformation, a displacement is generated in a parallelism between the tension supporting means, whereby a meandering is generated in the belt. When the meandering is generated in the belt, a deterioration in printing quality is caused by a deflection of image, and a displacement in color superimpose of the color image (hereinafter, expressed by a color misregistration). When the meandering becomes remarkable, there is a case that the belt falls away from the belt driving apparatus. Accordingly, a belt meandering preventing means is an important technique in a long belt driving apparatus having a long carrying path. As the meandering preventing means, there has been known a technique of compensating the meandering of the belt by setting at least one of the rollers supporting the belt in a tension manner to a steering roller supported in a tiltable manner, and adjusting an angle of incline of the steering roller in correspondence to a belt position detected by a sensor (refer to, for example, JP-A-4-144850).

BRIEF SUMMARY OF THE INVENTION

An object of the present invention is to inhibit a belt meandering for improving a printing quality and rapidly start a printing operation at a time of starting an image forming apparatus or the like, in the image forming apparatus provided with a belt driving apparatus.

The present invention provides a belt driving apparatus comprising:

an endless belt;

a plurality of belt tension supporting means for supporting the belt in a tension manner; and a steering roller supported in a tiltable manner and compensating a meandering of the belt, wherein the belt driving apparatus is provided with a meandering compensation sensitivity adjusting means for adjusting a belt meandering compensation sensitivity of the steering roller per an angle of incline.

In accordance with a first aspect of the present invention, there is provided a belt driving apparatus comprising:

an endless belt;

a plurality of belt tension supporting means for supporting the endless belt in a tension manner; and a driving means for driving the endless belt, wherein at least one of a plurality of belt tension supporting means is a steering roller which is tilted for compensating a meandering of the belt, and wherein the belt driving apparatus is provided with a meandering compensation sensitivity adjusting means for adjusting a meandering compensation sensitivity of the steering roller per an angle of incline.

In the aspect mentioned above, the structure may be made such that the meandering compensation sensitivity adjusting means is a belt tension supporting means which moves along a carrying path of the belt provided in an upstream side in a driving direction of the belt with respect to the steering roller.

In the aspect mentioned above, the structure may be made such that the belt tension supporting means moving along the belt carrying path is a roller following to the belt.

In the aspect mentioned above, the structure may be made such that the belt tension supporting means moving along the belt carrying path is a sliding member.

In the aspect mentioned above, the structure may be made such that the meandering compensation sensitivity adjusting means is a belt tension supporting means which retracts from a carrying path of the belt provided in an upstream side in a driving direction of the belt with respect to the steering roller.

In the aspect mentioned above, the structure may be made such that the belt tension supporting means retracting from the belt carrying path is a roller following to the belt.

In the aspect mentioned above, the structure may be made such that the belt tension supporting means retracting from the belt carrying path is a sliding member.

In accordance with a second aspect of the present invention, there is provided a belt driving apparatus comprising:

an endless belt;

a plurality of belt tension supporting means for supporting the endless belt in a tension manner; and a driving means for driving the endless belt, wherein at least two of a plurality of belt tension supporting means is a steering roller which is tilted for compensating a meandering of the belt, and wherein a meandering compensation sensitivity is different from each other in two or more steering rollers.

In the aspect mentioned above, the structure may be made such that rollers following to the belt are provided in an upstream side in a driving direction of the belt with respect to two or more steering rollers.

In the aspect mentioned above, the structure may be made such that sliding members are provided in an upstream side in a driving direction of the belt with respect to two or more steering rollers.

In accordance with a third aspect of the present invention, there is provided an image forming apparatus provided with a plurality of printing units, each printing unit comprising:

a photosensitive body;

a charging apparatus for charging a surface of the photosensitive body;

an exposure apparatus for exposing the surface of the photosensitive body; and a developing apparatus for forming a toner image on the surface of the photosensitive body, wherein the image forming apparatus comprises:

an endless intermediate transfer belt for conveying the toner image formed by a plurality of printing units to a transferring position onto a paper;

a tension supporting means for supporting the intermediate transfer belt in a tension manner;

a steering roller tilting for compensating a meandering of the intermediate transfer belt; and a meandering compensation sensitivity adjusting means for adjusting a meandering compensation sensitivity of the steering roller per an angle of incline.

In accordance with a fourth aspect of the present invention, there is provided an image forming apparatus provided with a plurality of printing units, each printing unit comprising:

a photosensitive body;

a charging apparatus for charging a surface of the photosensitive body;

an exposure apparatus for exposing the surface of the photosensitive body; and a developing apparatus for forming a toner image on the surface of the photosensitive body, wherein the image forming apparatus comprises:

an endless intermediate transfer belt for conveying the toner image formed by a plurality of printing units to a transferring position onto a paper;

an endless belt;

a tension supporting means for supporting the endless belt in a tension manner;

a steering roller tilting for compensating a meandering of the endless belt; and a meandering compensation sensitivity adjusting means for adjusting a meandering compensation sensitivity of the steering roller per an angle of incline.

Other objects, features and advantages of the invention will become apparent from the following description of the embodiments of the invention taken in conjunction with the accompanying drawings.

DETAILED DESCRIPTION OF THE INVENTION

A description will be given below of embodiments in accordance with the present invention with reference to the accompanying drawings.

Figure 1:
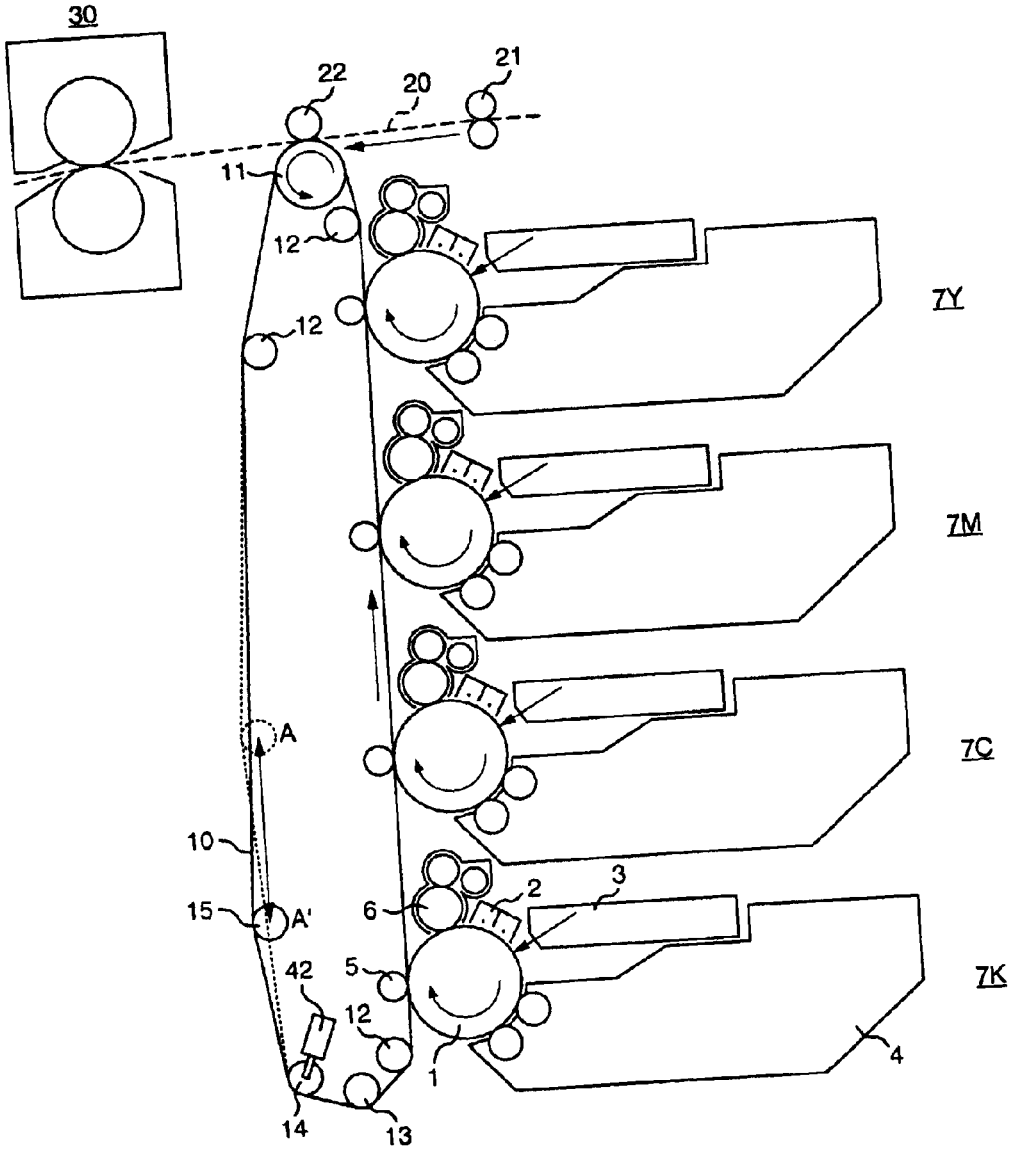
FIG. 1 is a schematic view of an image forming apparatus in accordance with a first embodiment of the present invention.

FIG. 1 is a schematic view of a color image forming apparatus provided with a belt driving apparatus in accordance with a first embodiment of the present invention. A description will be given below of an outline structure of the color image forming apparatus.

A printing unit 7K for a black (K) toner is provided with a photosensitive body 1 corresponding to an image carrier, a charging apparatus 2 for charging evenly a surface of the photosensitive body 1, an exposure apparatus 3 for exposing the surface of the photosensitive body 1 by using a laser beam, an LED or the like, a developing apparatus 4 storing a developing agent of the black toner, a primary transfer roller 5 for primarily transferring the black toner attached onto the photosensitive body 1 to an intermediate transfer belt 10, and a cleaner 6 for cleaning the black toner left on the photosensitive body 1 without being transferred. In this case, the same structure as that of the printing unit 7K is applied to each of a printing unit 7C for a cyan (C) toner, a printing unit 7M for a magenta (M) toner and a printing unit 7Y for a yellow (Y) toner.

Further, the belt driving apparatus is provided with a belt tension supporting means such as a driving roller 11 for driving the intermediate transfer belt 10, an idle roller 12 for defining a belt carrying path, a tension roller 13 for applying a tensile force for stably carrying the intermediate transfer belt 10, a steering roller 14 for compensating a meandering speed in a belt width direction, a roller 15 corresponding to a meandering compensation sensitivity adjusting means and the like, in addition to the intermediate transfer belt 10. The intermediate transfer belt 10 is driven by the driving roller 11 in a direction of an arrow, and carries a toner image formed by each of the printing units to a position of a secondary transfer roller 22. Further, since the intermediate transfer belt 10 is worn out in accordance with a frequency in use, the structure is made such that the belt driving apparatus of the intermediate transfer belt 10 is freely attached to and detached from an image forming apparatus main body for replacement.

Figure 6:
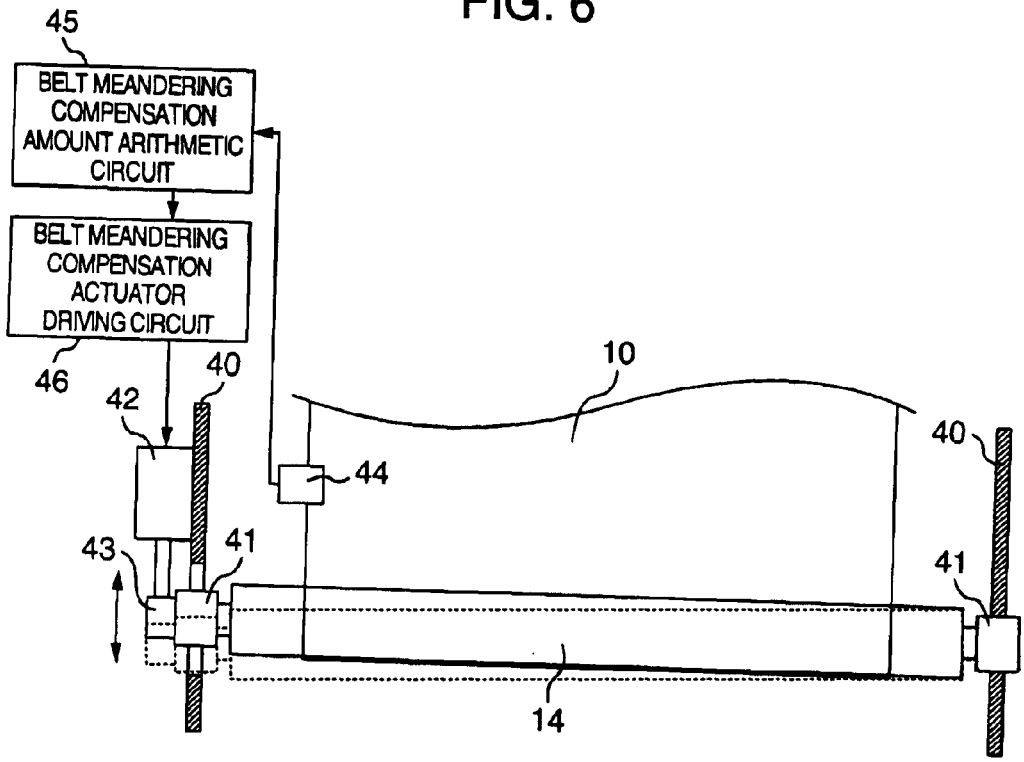
FIG. 6 is a schematic view showing a motion of a steering roller.

A description will be given next of a tilting motion of the steering roller 14 with reference to FIG. 6. The steering roller 14 is structured such that both ends of a rotation axis are supported to a bearing 41, and the bearing 41 at one end is movably supported to a supporting frame 40 of the belt tension supporting means. The movably supported bearing 41 is mounted to an actuator 42 via a connection member 43, and the steering roller 14 is tilted on the basis of a displacement of the actuator 42. An amount of meandering of the intermediate transfer belt 10 is detected by an optical or contact belt position detecting sensor 44, and a belt meandering compensation actuator driving circuit 46 drives the actuator 42 in correspondence to a compensation amount computed by a belt meandering compensation amount arithmetic circuit 45, and tilts the steering roller 14 at a predetermined amount, whereby a meandering compensation of the intermediate transfer belt 10 is carried out.

In this case, in the conventional image forming apparatus, since it is necessary to restrict a color misregistration to a level equal to or less than some tens μm at a time of forming the image onto the intermediate transfer belt by each of the printing units, it is necessary to set a compensation amount of a meandering speed (hereinafter, refer to a meandering compensation sensitivity) of the intermediate transfer belt to a small amount.

On the other hand, at a time of starting the image forming apparatus or at a time of replacing the intermediate transfer belt, there is a case that an initial set position of the intermediate transfer belt is displaced. Further, there is a case that a comparatively great deformation is generated in a mounting member of the belt tension supporting means, at a time of moving the image forming apparatus main body or at a time when an environmental temperature is changed. In these cases, in order to rapidly start the printing motion, it is necessary to set the meandering compensation sensitivity of the intermediate transfer belt to a great value.

However, in the conventional belt driving apparatus, the meandering compensation sensitivity of the steering roller per an angle of incline is fixed. Accordingly, in the case that the meandering compensation sensitivity is set small for inhibiting the color misregistration, it is impossible to shorten a time required until starting the printing motion, and in the case that the meandering compensation sensitivity is set great for starting the rapid printing motion, it is hard to inhibit the color misregistration with high accuracy.

Next, a description will be given in detail of an image forming process in accordance with the present invention with reference to FIG. 1.

First, in the printing unit 7K, the charging apparatus 2 applies an electric charge onto the surface of the photosensitive body 2. Next, the electric charge is removed by exposing a light beam output from the exposure apparatus 3 to a position corresponding to an input image data on the surface of the photosensitive body 1, and a latent image is formed on the surface of the photosensitive body 1. A toner image is formed on the surface of the photosensitive body 1 by applying the black toner to the formed latent image by means of the developing apparatus 4. The toner image formed on the surface of the photosensitive body 1 is transferred on the surface of the intermediate transfer belt 10 by the primary transfer roller 5.

In the printing units 7C, 7M and 7Y, a monochromatic toner image is formed on the intermediate transfer belt 10 with respect to each of the toners C, M and Y in the same manner. These toner images of the respective monochromatic colors K, C, M and Y are superimposed on the intermediate transfer belt 10, whereby a color toner image is formed.

A paper fed from a paper feeder (not shown) is carried on a paper carrying path 20 while being positioned by a registration roller 21. The color toner image formed on the surface of the intermediate transfer belt 10 is transferred on a surface of the paper by a secondary transfer roller 22. Thereafter, the paper passes through a fixing apparatus 30, whereby the toner image is heated by the fixing apparatus 30 so as to be fixed on the paper. Accordingly, the color image forming process is finished, and the paper is delivered to a paper delivery apparatus (not shown).

In this case, the belt driving apparatus in accordance with the first embodiment of the present invention is structured such that the roller 15 corresponding to the meandering compensation sensitivity adjusting means is movably supported between points A and A' in FIG. 1 while keeping a state of supporting the belt in a tension manner. The roller 15 is rotated following to the carry of the belt. In FIG. 1, a solid line shows a tension supported position of the intermediate transfer belt 10 at a time when the roller 15 is at the position A', and a dotted line shows a tension supported position of the intermediate transfer belt 10 at a time when the roller 15 is at the position A. A description will be in detail given below of the meandering compensation sensitivity adjusting means.

Figure 7:
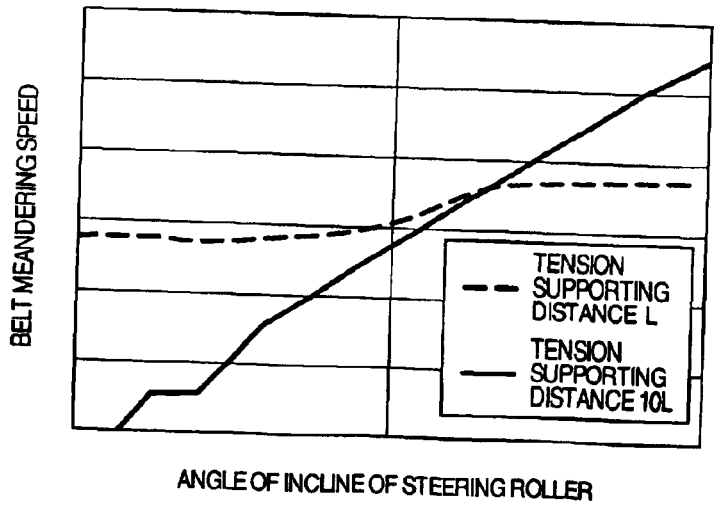
FIG. 7 is a graph showing a change in a meandering compensation sensitivity by a tension supporting distance.

FIG. 7 is a graph showing a relation between a belt tension supporting distance between the roller 15 adjacent to an upstream side of the steering roller 14 in a belt driving direction and the steering roller 14, and a meandering speed of the intermediate transfer belt 10. A dotted line shows an example in which the tension supporting distance being ten times that of the solid line is provided with respect to the solid line. Accordingly, it is known that the smaller the belt tension supporting distance is, the smaller a fluctuation of the meandering speed with respect to an angle of incline of the steering roller 14 is (the smaller the meandering compensation sensitivity is). On the contrary, it is also known that the larger the belt tension supporting distance is, the larger the fluctuation of the meandering speed with respect to the angle of incline of the steering roller 14 is (the larger the meandering compensation sensitivity is).

Figure 2:
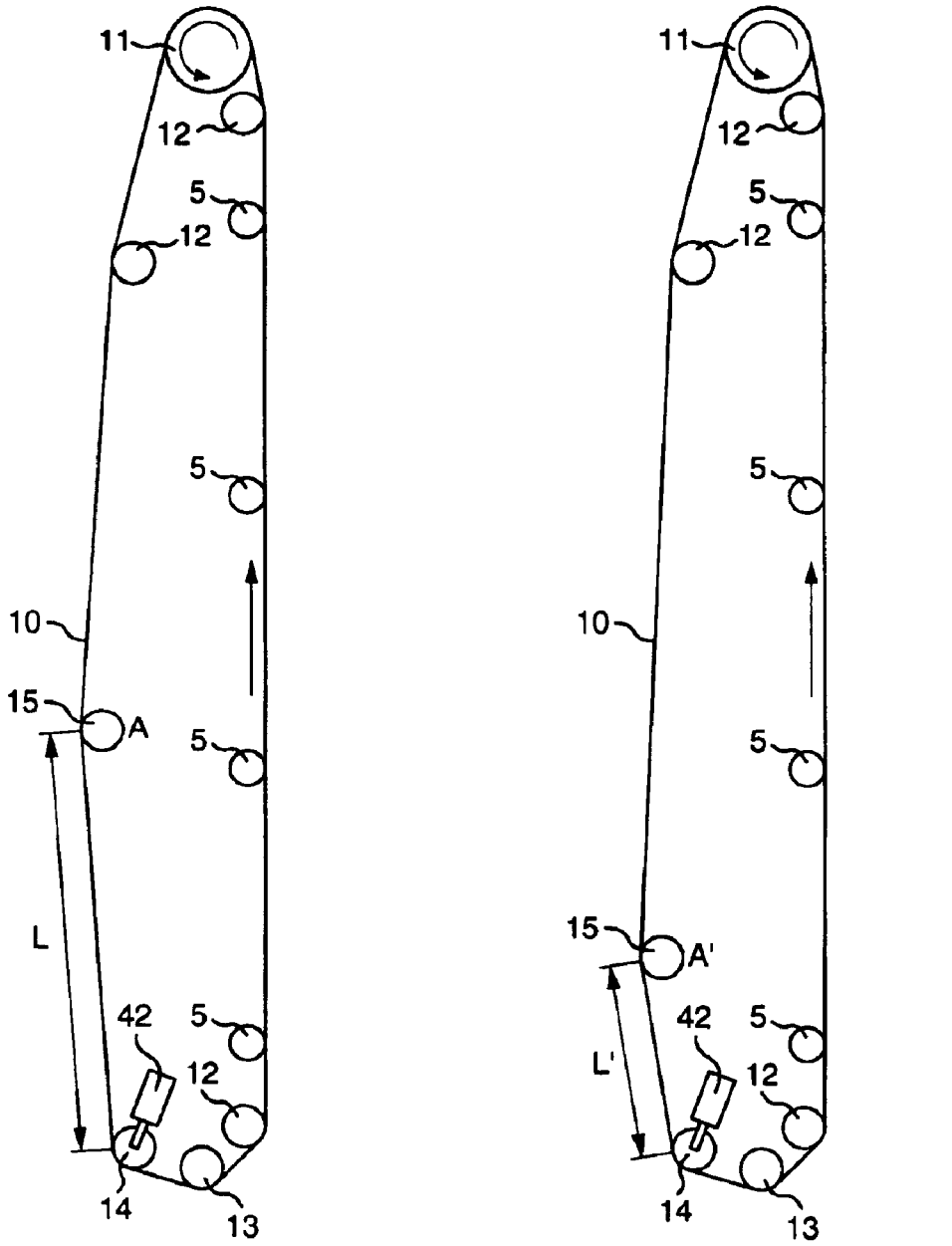
FIG. 2 is a schematic view showing a method of adjusting a meandering compensation sensitivity in a belt driving apparatus in accordance with the first embodiment of the present invention.

Accordingly, in the case of roughly adjusting the belt meandering, the roller 15 is moved to the position A by using a moving means (not shown) as shown in FIG. 2(*a*). The meandering compensation sensitivity can be set great by making a belt tension supporting distance L between the steering roller 14 and the roller 15 adjacent to the upstream side of the intermediate transfer belt 10 in the driving direction.

On the contrary, in the case of fine adjusting the belt meandering, the roller 15 is moved to the position A' as shown in FIG. 2(*b*), and a belt tension supporting distance L' between the steering roller 14 and the roller 15 is made smaller than the distance L in FIG. 2(*a*). As a result, The meandering compensation sensitivity can be set smaller than the meandering compensation sensitivity in the case that the roller 15 is provided at the position A.

Figure 8:
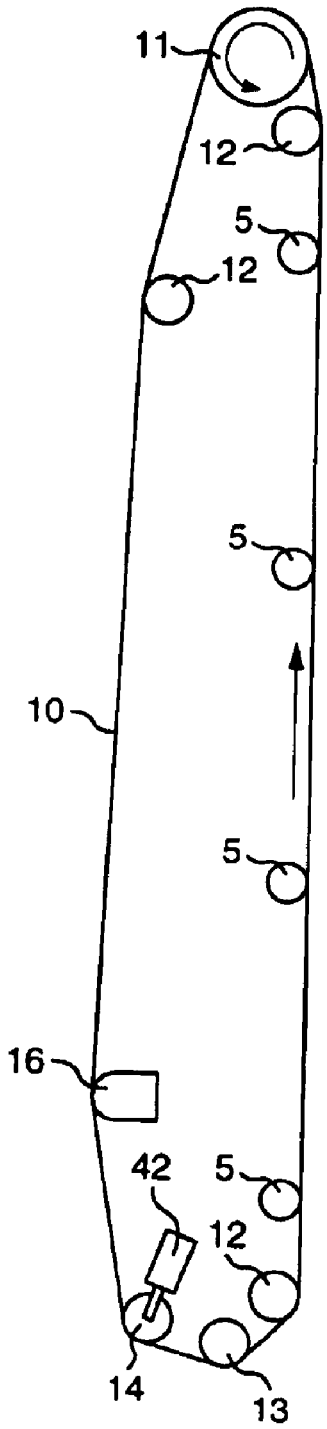
FIG. 8 is a schematic view of an image forming apparatus using a sliding member.

In this case, in FIGS. 1 and 2, the roller 15 is shown as the adjusting means for adjusting the meandering compensation sensitivity, however, the structure may be made such that a sliding member 16 shown in FIG. 8 is employed in place of the roller 15, and is supported movably in the same manner as that in FIG. 1.

Figure 3:
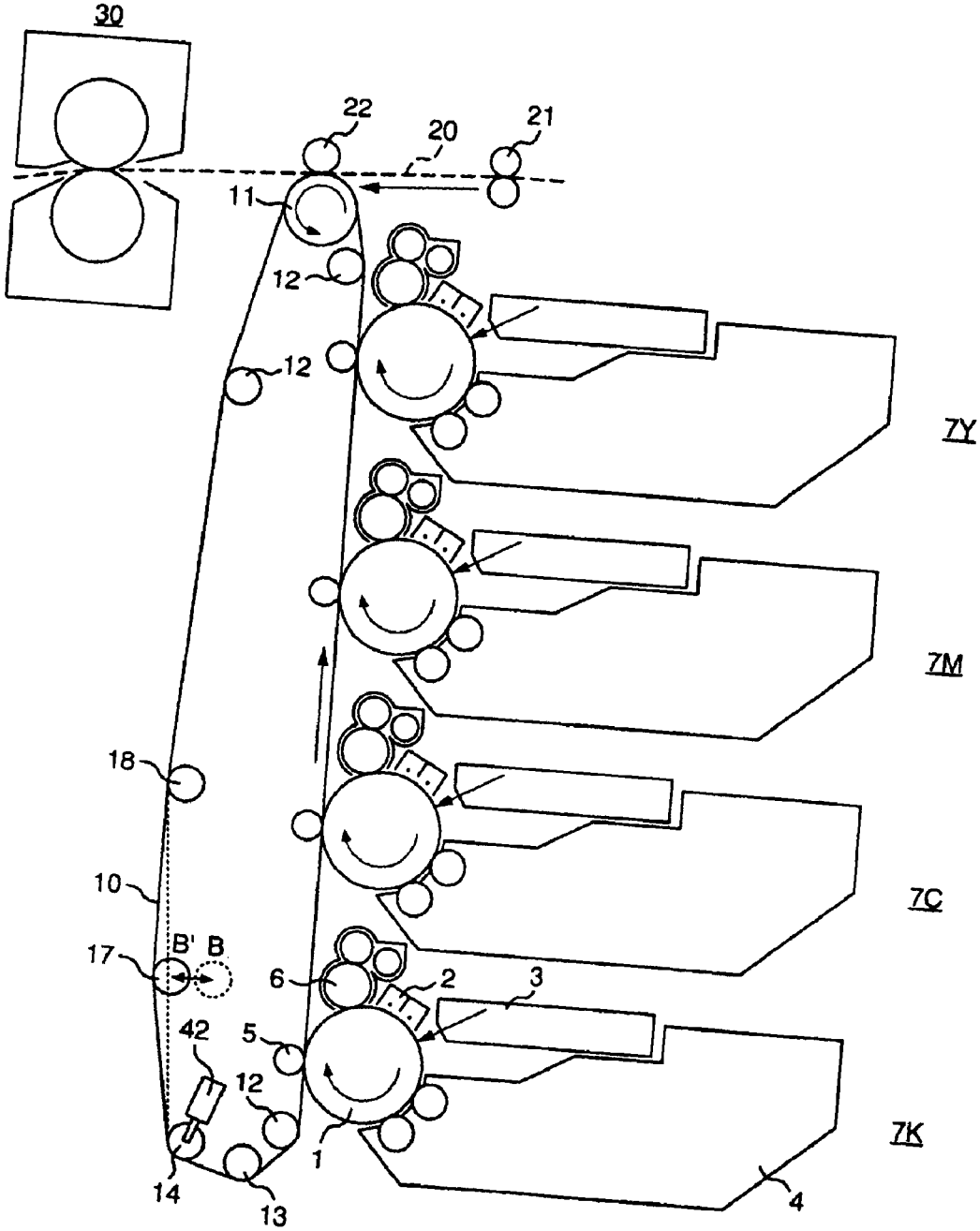
FIG. 3 is a schematic view of an image forming apparatus in accordance with a second embodiment of the present invention.

FIG. 3 is a schematic view of a color image forming apparatus provided with a belt driving apparatus in accordance with a second embodiment of the present invention.

In the present embodiment, the structure is made such that a roller 17 corresponding to the meandering compensation sensitivity adjusting means can be retracted to a position B at which the roller 17 does not support the intermediate transfer belt 10 in a tension manner, from a position B' at which the roller 17 supports the intermediate transfer belt 10 in a tension manner.

Figure 4:
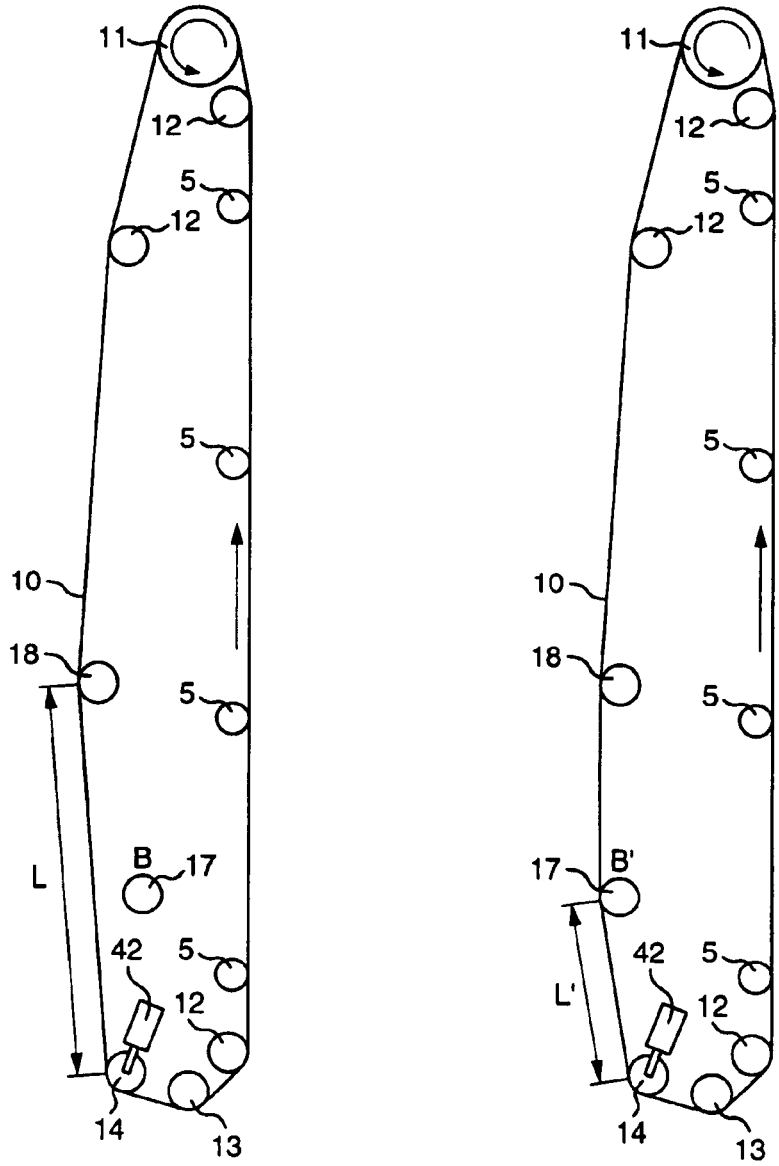
FIG. 4 is a schematic view showing a method of adjusting a meandering compensation sensitivity in a belt driving apparatus in accordance with the second embodiment of the present invention.

Here, in the case of roughly adjusting the belt meandering, the roller 17 is retracted to the position B as shown in FIG. 4(*a*), and the belt is supported in a tension manner between the steering roller 14 and a roller 18. As a result, the belt tension supporting distance L is allowed to be kept large, and the meandering compensation sensitivity can be set great. On the contrary, in the case of fine adjusting the belt meandering, the roller 17 is moved to the position B' as shown in FIG. 4(*b*), the belt is supported in a tension manner between the steering roller 14 and the roller 17, and a belt tension supporting distance L' is made smaller than the belt tension supporting distance L in FIG. 4(*a*), whereby the meandering compensation sensitivity is set smaller than that of FIG. 4(*a*).

In this case, in the structure in FIG. 4, in the same manner as that of the first embodiment, the sliding member 16 shown in FIG. 8 may be employed as the meandering compensation sensitivity adjusting means in place of the roller 17.

Figure 5:
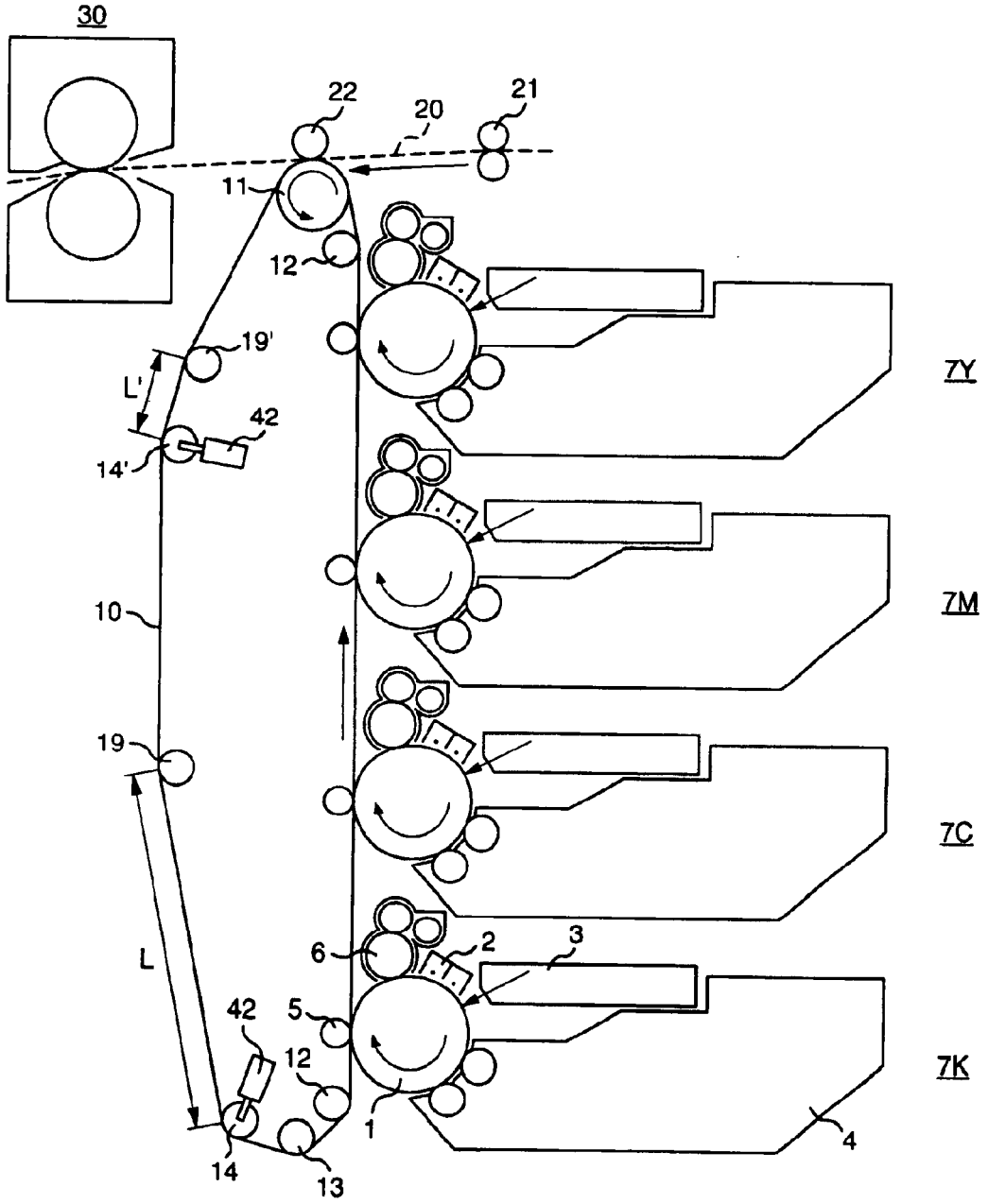
FIG. 5 is a schematic view of an image forming apparatus in accordance with a third embodiment of the present invention.

FIG. 5 is a schematic view of a color image forming apparatus provided with a belt driving apparatus in accordance with a third embodiment of the present invention.

In the present embodiment, two steering rollers 14 and 14' are used. The steering roller 14 is supported in a tension manner with respect to an upstream side roller 19 in a driving direction of the intermediate transfer belt 10, and the belt tension supporting distance L is large, so that the meandering compensation sensitivity is great. The steering roller 14' is supported in a tension manner with respect to an upstream side roller 19', and the belt tension supporting distance L' is smaller than the belt tension supporting distance L, so that the meandering compensation sensitivity is small. Accordingly, in the case of roughly adjusting the belt meandering, the steering roller 14 is tilted, and in the case of fine adjusting the belt meandering, the steering roller 14' is tilted, respectively.

In this case, in the present embodiment, the sliding member 16 shown in FIG. 8 may be employed in place of the rollers 19 and 19'. Further, the meandering compensation sensitivity adjusting means mentioned in the first embodiment may be used together in the present embodiment.

As mentioned above, it is possible to achieve a fine adjustment and a rough adjustment of the belt meandering speed by using the belt driving apparatus shown in each of the embodiments.

Further, all the embodiments mentioned above are not limited to the intermediate transfer belt, and the same effect can be obtained also by being applied to a paper carrying belt which carries the paper in a state of adsorbing the paper on the belt. Further, the present invention may be applied to a printing in black and white for inhibiting the meandering of the paper, although the color misregistration is small in comparison with the color printing.

In accordance with the present invention, in the image forming apparatus provided with the belt driving apparatus, it is possible to rapidly start the printing motion at a time of starting the image forming apparatus or the like, as well as it is possible to improve the printing quality by inhibiting the belt meandering.

It should be further understood by those skilled in the art that the foregoing description has been made on embodiments of the invention and that various changes and modifications may be made in the invention without departing from the spirit of the invention and the scope of the appended claims.

What is claimed is:

1. A belt driving apparatus comprising:

an endless belt;

a plurality of belt tension supporting means for supporting said endless belt in a tension manner; and a driving means for driving said endless belt, wherein at least one of said plurality of belt tension supporting means is a steering roller which is tilted for compensating a meandering of said belt;

wherein said belt driving apparatus is provided with a meandering compensation sensitivity adjusting means for adjusting a meandering compensation sensitivity of said steering roller per an angle of incline; and wherein said meandering compensation sensitivity adjusting means is a belt tension supporting means which moves along a carrying path of said belt provided in an upstream side in a driving direction of said belt with respect to said steering roller.

2. A belt driving apparatus as claimed in claim 1, wherein the belt tension supporting means moving along said belt carrying path is a roller following to the belt.

3. A belt driving apparatus as claimed in claim 1, wherein the belt tension supporting means moving along said belt carrying path is a sliding member.

4. A belt driving apparatus comprising:

an endless belt;

a plurality of belt tension supporting means for supporting said endless belt in a tension manner; and a driving means for driving said endless belt, wherein at least one of said plurality of belt tension supporting means is a steering roller which is tilted for compensating a meandering of said belt;

wherein said belt driving apparatus is provided with a meandering compensation sensitivity adjusting means for adjusting a meandering compensation sensitivity of said steering roller per an angle of incline; and wherein said meandering compensation sensitivity adjusting means is a belt tension supporting means which moves along a carrying path of said belt provided in an upstream side in a driving direction of said belt with respect to said steering roller.

5. A belt driving apparatus as claimed in claim 4, wherein the belt tension supporting means retracting from said belt carrying path is a roller following to the belt.

6. A belt driving apparatus as claimed in claim 4, wherein the belt tension supporting means retracting from said belt carrying path is a sliding member.

7. A belt driving apparatus comprising:

an endless belt;

a plurality of belt tension supporting means for supporting said endless belt in a tension manner; and a driving means for driving said endless belt, wherein at least two of said plurality of belt tension supporting means are steering rollers which are tilted for compensating a meandering of said belt, and wherein a meandering compensation sensitivity is different from each other in said two or more steering rollers.

8. A belt driving apparatus as claimed in claim 7, wherein rollers following to said belt are provided in an upstream side in a driving direction of said belt with respect to said two or more steering rollers.

9. A belt driving apparatus as claimed in claim 7, wherein sliding members are provided in an upstream side in a driving direction of said belt with respect to said two or more steering rollers.

10. An image forming apparatus provided with a plurality of printing units, each printing unit comprising:

a photosensitive body;

a charging apparatus for charging a surface of said photosensitive body;

an exposure apparatus for exposing the surface of said photosensitive body; and a developing apparatus for forming a toner image on the surface of said photosensitive body, wherein the image forming apparatus comprises:

an endless intermediate transfer belt for conveying the toner image formed by said plurality of printing units to a transferring position onto a paper;

a tension supporting means for supporting said intermediate transfer belt in a tension manner;

a steering roller tilting for compensating a meandering of said intermediate transfer belt; and a meandering compensation sensitivity adjusting means for adjusting a meandering compensation sensitivity of said steering roller per an angle of incline;

wherein said meandering compensation sensitivity adjusting means is a belt tension supporting means which moves along a carrying path of said belt provided in an upstream side in a driving direction of said belt with respect to said steering roller.

11. A belt driving apparatus as claimed in claim 10, wherein the belt tension supporting means moving along said belt carrying path is a roller following to the belt.

12. A belt driving apparatus as claimed in claim 10, wherein the belt tension supporting means moving along said belt carrying path is a sliding member.

13. An image forming apparatus provided with a plurality of printing units, each printing unit comprising:

a photosensitive body;

a charging apparatus for charging a surface of said photosensitive body;

an exposure apparatus for exposing the surface of said photosensitive body; and a developing apparatus for forming a toner image on the surface of said photosensitive body, wherein the image forming apparatus comprises:

an endless intermediate transfer belt for conveying the toner image formed by said plurality of printing units to a transferring position onto a paper;

a tension supporting means for supporting said intermediate transfer belt in a tension manner;

a steering roller tilting for compensating a meandering of said intermediate transfer belt; and a meandering compensation sensitivity adjusting means for adjusting a meandering compensation sensitivity of said steering roller per an angle of incline;

wherein said meandering compensation sensitivity adjusting means is a belt tension supporting means which retracts from a carrying path of said belt provided in an upstream side in a driving direction of said belt with respect to said steering roller.

14. A belt driving apparatus as claimed in claim 13, wherein the belt tension supporting means retracting from said belt carrying path is a roller following to the belt.

15. A belt driving apparatus as claimed in claim 13, wherein the belt tension supporting means retracting from said belt carrying path is a sliding member.

* * * * *